US005749677A

United States Patent [19]

Grigoraschenko et al.

[11] Patent Number: 5,749,677

[45] Date of Patent: May 12, 1998

[54] APPARATUS FOR IMPACT ACTION

[75] Inventors: Vladimir Alexandrovich Grigoraschenko; Veniamin Viktorovich Kamensky, both of Novosibirsk; Vladimir Alexeevich Klimenko, Omsk; Mikhail Vladimirovich Kurlenya, Novosibirsk; Vladimir Dmitrievich Plavskih, Novosibirsk; Anatoly Antonovich Repin, Novosibirsk; Sergei Konstantinovich Tupitsin, Novosibirsk; Sergei Jurievich Fetisov, Novosibirsk, all of Russian Federation

[73] Assignee: Institut gornogo dela Sibirskogo otdelenia Rossiiskoi Akademii nauk, Russian Federation

[21] Appl. No.: 658,442

[22] Filed: Jun. 10, 1996

[51] Int. Cl.[6] ..... E02F 5/10; E21B 4/14; B25D 9/00

[52] U.S. Cl. ..... 405/184; 405/154; 175/296; 173/90

[58] Field of Search ..... 405/154, 184; 173/90, 91; 175/296

[56] References Cited

U.S. PATENT DOCUMENTS

| | | | |
|---|---|---|---|
| 3,651,874 | 3/1972 | Sudnishnikov et al. | 173/91 |
| 3,995,702 | 12/1976 | Klimashko et al. | 173/91 |
| 4,284,147 | 8/1981 | Jenne | 173/91 |
| 4,295,533 | 10/1981 | Schmidt | 175/19 |
| 4,537,265 | 8/1985 | Cox et al. | 175/19 |
| 4,634,313 | 1/1987 | Robbins | 405/184 |
| 4,709,768 | 12/1987 | Kostylev et al. | 175/296 |
| 4,722,403 | 2/1988 | Kostylev et al. | 175/296 |
| 4,785,898 | 11/1988 | Kostylev et al. | 175/19 |
| 4,871,034 | 10/1989 | Schmidt | 173/90 |
| 4,913,243 | 4/1990 | Jenne et al. | 175/57 |
| 4,964,477 | 10/1990 | Tupitsyn et al. | 175/296 |
| 5,050,686 | 9/1991 | Jenne | 173/91 |
| 5,074,364 | 12/1991 | Hesse | 173/91 |
| 5,094,303 | 3/1992 | Jenne | 173/91 |
| 5,109,932 | 5/1992 | Bueter et al. | 173/17 |
| 5,193,627 | 3/1993 | Jenne | 175/19 |
| 5,307,883 | 5/1994 | Jenne | 175/19 |
| 5,337,837 | 8/1994 | Wentworth et al. | 175/19 |
| 5,377,551 | 1/1995 | Vacquer | 73/533 |
| 5,494,116 | 2/1996 | Wentworth | 173/17 |

*Primary Examiner*—Tamara L. Graysay
*Assistant Examiner*—Gary S. Hartmann
*Attorney, Agent, or Firm*—Ostrolenk, Faber, Gerb & Soffen, LLP

[57] ABSTRACT

The present invention relates to building and to mining, more particularly to an apparatus for impact action designed for trenchless laying of new underground communications and for reconstruction of existing communications, the apparatus comprising a body, a striker with a through central channel, the striker positioned inside the body with the possibility of performing reciprocal movement, a front chamber formed between the body and striker, a rear chamber formed between the body and the striker, an air distribution system comprising channels for the inlet of compressed air into the chambers and channels for the exhaust of spent air from the chambers, an air conduit, and in which in accordance with the invention the air distribution system is provided autonomously for each of the aforesaid chambers.

5 Claims, 2 Drawing Sheets

APPARATUS FOR IMPACT ACTION

SPECIFICATION

FIELD OF THE INVENTION

The present invention relates to building and to mining, and more particularly, to an apparatus for impact action designed for trenchless laying of new underground communications and for reconstruction of existing communications.

BACKGROUND OF THE INVENTION

At present there is an acute problem of carrying out building, repair and prophylactic work related to laying, replacing, reconstructing old underground engineering networks without performing stripping (earth-moving) work. This problem is especially acute when that work is being carried out in cities where it is accompanied by obstruction of transport, destruction of existing transport communications, there is the danger of damaging existing telephone, gas, water-supply and other systems.

At present this problem is being solved using the technology of trenchless laying of new and replacement of existing different purpose pipelines. This technology provides for the use of apparatuses of impact action, the use of which makes it possible to substantially reduce or completely eliminate stripping (earth-moving) work, and this is especially noteworthy in urban conditions.

Well known to a specialist in this field of engineering is a reverse pneumatic punch for trenchless laying of pipelines ("Pneumatic punches in the building industry," A. D. Kostilev et al, Novosibirsk, "Nauka," Siberian branch, 1987, pp. 5, 6), comprising a body, a striker mounted in the body capable of performing reciprocal movement, a nut fixed in the body from the side of one of its end faces, an air distribution pipe positioned in the body between the striker and the nut and mounted in the nut capable of movement, and a hose connected at one end to the air distribution pipe, and at the other end to a source of compressed air. The inner surface of the body and the outer surface of the striker form a front chamber, while the inner cavity of the striker and the pipe form a rear chamber which through the axial channel of the pipe and the air supply hose communicates to the source of compressed air. Furthermore, radial windows are made in the striker for periodically communicating the front chamber when the striker moves.

The aforedescribed pneumatic punch operates in the following manner. When the striker is in the position of impact compressed air passes from the source of compressed air along the air supply hose, then through the air distribution pipe into the rear chamber of the pneumatic punch. From the rear chamber of the pneumatic punch the compressed air through the radial windows passes into the front chamber of the pneumatic punch. Due to the differences in the areas of the striker, receiving the pressure of the compressed air and located at the sides of the front and rear chambers, the striker moves to the air distribution pipe, i.e. performs a backward movement. As a result of movement of the striker, the radial windows made in the striker are closed by a sleeve of the air distribution pipe, which results in cutting off the supply of compressed air into the front chamber of the pneumatic punch. After the windows have closed the striker continues to move due to expansion of the air in the front chamber and due to the kinetic energy acquired during the acceleration period. When the radial windows of the striker pass the rear edge of the sleeve of the air distribution pipe, spent air is released into the environment from the front chamber of the pneumatic punch through the radial windows of the striker and openings made in the rear portion of the body. The working stroke of the striker is accomplished under the pressure of the compressed air fed into the rear chamber of the pneumatic punch and is completed by impact of the striker against the front portion of the body. Before the impact the radial windows are opened by an edge of the air distribution pipe and they communicate the front chamber of the pneumatic punch with the source of compressed air. In this manner the cycle of operation of the pneumatic punch is repeated many times.

The pneumatic punch described above makes it possible to lay wells, widen the diameter of earlier formed wells, drive pipes, etc. This apparatus is used in the compression of earth, formation of piles and other building operations.

However the presence in the construction of the pneumatic punch of a rear chamber which is uncontrollable and is always under the high pressure of the compressed air limits the use of the impact area which takes the pressure of the compressed air, and, consequently, due to this does not make it possible to obtain high energetic indexes.

Furthermore, the presence of radial windows in the construction of the striker, which are a source of concentration of tensions, substantially reduces the strength of the striker, which finally results in its destruction and, consequently, to a breakdown of the pneumatic punch. This reduces the reliability and service life of operation of the pneumatic punch.

Most similar to the proposed invention is the apparatus for impact action developed by the "Mission" firm ("Pneumatic machines for impact action for driving wells and blastholes," N. N. Esin, A. L. Kostilev et al, Novosibirsk, "Nauka," Siberian branch, 1986, p. 34) and comprising a hollow body in which a striker, which has an axial channel and a cavity, is mounted. The striker forms two chambers with the body, one of which is a front chamber, the second—a rear chamber. A central air distributor having channels for communicating the aforesaid cavity with the source of compressed air and channels for the periodical communication of the chambers either with the source of compressed air or with the environment is mounted in the axial channel of the striker. Wherein the channel for exhaust of spent air into the environment serves for both the front chamber of the apparatus and for its rear chamber.

The apparatus for impact action described above operates in the following manner. At the moment when the striker is in the impact position, compressed air from the source of compressed air is fed from the source of compressed air along the channel of the air distributor to a bore made in the striker, from there through slots made in the front portion of the air distributor is fed into the front chamber of the apparatus for impact action. Since the rear working chamber at that moment communicates with the environment through a channel made in the air distributor, the striker under the effect of the pressure of compressed air is displaced in the opposite direction. While the striker is moving in the opposite direction, slots made in the front portion of the air distributor are closed which results in a stoppage of the inlet of compressed air into the front chamber of the apparatus, then the opening for exhaust of compressed air from the rear chamber of the apparatus along the channel of the air distributor is closed. However, the striker continues to move due to expansion of the air in the front chamber and due to the kinetic energy acquired by the striker during its acceleration. The inner bore communicates the source of compressed air to the rear chamber of the apparatus through slots made in the rear portion of the air distributor, and at that moment exhaust of the spent air from the front chamber of the apparatus into the environment takes place. The striker under the effect of the pressure of the compressed air fed into the rear chamber of the apparatus stops and then accelerating makes an impact against the front portion of the body of the apparatus. Prior to the impact of the striker against the front portion of the body, the rear end face of the striker opens the opening for exhaust of the compressed air from the rear chamber into the environment through a channel made in the air distributor. The cycle of operation of the apparatus for impact action described above is repeated a number of times.

The apparatus described above makes it possible to effect driving of wells. The presence in the construction of the apparatus of two controllable front and rear chambers makes it possible to effectively use the area of the striker, receiving the pressure of the compressed air, which in this construction are used to their full extent in practice, which finally makes it possible to obtain greater impact energy as compared with the pneumatic punch for trenchless laying of pipelines described above. Furthermore, elimination of any kind of radial windows or channels reducing the strength of the striker from the construction of the striker makes it possible to enhance the reliability and service life of the apparatus as compared with the pneumatic punch for trenchless laying of pipelines described above.

However, a substantial drawback of the apparatus for impact action described above is the complexity of its structure, and as a consequence thereof, low reliability and service life. Furthermore, the complexity of the construction of the apparatus makes it difficult to make this apparatus. Basically this drawback is due to the presence of only one central air distributor secured on two sides in the body of the apparatus and having a single system of channels for control of both chambers, wherein it should be kept in mind that these channels have a long length, and consequently have a large resistance for the compressed air passing along those channels. Furthermore the "striker-air distributor" pair requires very exact manufacturing and tends to jam with even very small bends of the air distributor, which are inevitable during operation of the apparatus. Another substantial drawback of this apparatus is its limited functional possibilities, since the rear positioning of the air duct makes it difficult to use the apparatus during the reconstruction of old pipelines due to the fact that the air duct hinders the pulling of new pipes behind the described apparatus for impact action.

SUMMARY OF THE INVENTION

In accordance with the foregoing the object of the present invention is to increase the power of the apparatus for impact action while maintaining the size of the apparatuses for impact action of already known constructions.

The next object of the present invention is to increase the reliability of operation of the apparatus for impact action as compared with apparatuses of impact action of known constructions.

One more object of the present invention is to enhance the energetic parameters of the apparatus for impact action as compared with apparatuses of impact action of known constructions.

One more object of the present invention is to expand the technological capabilities of the apparatus for impact action.

Other general and specific objects of the invention will in part be obvious and will in part appear hereinafter.

The aforesaid and other objects are achieved in that in an apparatus for impact action comprising a body, a striker having a central through bore and positioned in the body, a front chamber, a rear chamber, an air distribution system comprising channels for inlet of a fluid medium (air) into the aforesaid chambers and for exhaust therefrom, and an air duct, in accordance with the invention, the air distribution system is made autonomous for each chamber.

Autonomy of the chambers is accomplished due to the fact that one group of separate channels for the inlet and exhaust of compressed air into and out of the front chamber is used to ensure operation of the front chamber, and other separate channels for the inlet and exhaust of compressed air into and out of the rear chamber are used to ensure operation of the rear chamber. Autonomous realization of the system of air distribution for each chamber separately makes it possible to improve the conditions for filling the chambers with compressed air and the conditions for exhaust therefrom, due to reduction of the length of the air supply and exhaust channels and due to an increase of their cross sections, which finally makes it possible to increase the impact frequency, and consequently, the power of the whole apparatus while maintaining the size of the apparatus for impact action of already known constructions.

Furthermore, the technology of production of such apparatuses is substantially simplified due to the fact that channels of the air distribution system have a lesser length, and, as is well known to specialists in this field of engineering, the production of parts having shorter channels is less complex, i.e. more technological and requires less expenditures in production.

It would be advisable that in an apparatus for impact action made in accordance with the present invention, the system of air distribution would be made in the form of a sleeve with channels for the inlet and exhaust of compressed air into or out of working chambers, consisting of at least two parts cantilever supported in the end faces of the body. Making the system of air distribution in the form of a sleeve with channels for the inlet and exhaust of compressed air into and out of the working chambers, consisting of at least two parts cantilever supported in the end faces of the body, makes it possible for parts of the system of air distribution disposed in the axial channel of the striker to have an additional degree of freedom within the limits of deviation of the dimensions when making conjugating surfaces of the sleeves and surfaces of the central bore of the striker. This makes it possible to enhance the possibility for their self-mounting in the central bore of the striker, which in turn reduces the probability of jamming, i.e. increases the reliability of operation of the apparatus as a whole. Division of the air distribution system into two sleeves with channels for the inlet and exhaust of compressed air ensures reduction of dynamic loads at points where the sleeves are secured in the body, and this is achieved in particular due to the fact that each of the sleeves has a lesser weight.

Furthermore, it would be sensible that in an apparatus made in accordance with present invention, the air duct would be connected to only one of the end faces of the body.

The above-described construction of the apparatus makes it possible to connect the air duct either to the front or to the rear end face of the body, and if necessary both from the side of the front and from the side of the rear end face of the body. This substantially enhances the energetic parameters of the apparatus due to reduction of the length of the channels and an increase of their flow sections. The concept of energetic parameters of the apparatus for impact action is understood to mean the energy of a single impact by the striker and the power of the whole apparatus. This is achieved due to the fact that in order to supply the necessary amount of compressed air into the working chambers of the apparatus, a certain cross section of the channels is necessary, while supplying compressed air from the sides of the front and rear end faces of the body makes it possible to increase the flow section of the channels, i.e. increase the energy of a single impact.

It is just as advisable that in an apparatus for impact action, made in accordance with the present invention, the sleeve parts would be secured to the body by means of elastic elements.

Securing the system of air distribution by means of elastic elements substantially reduces the transmission of dynamic loads from the body of the apparatus to its system for air distribution. Moreover, the elastic elements make it possible for the sleeves of the air distribution system to have a certain degree of radial mobility, which makes substantially easier the possibility for self-mounting of the sleeves in the central bore of the striker, which increases the reliability of operation of the whole apparatus.

Attention should be directed to the fact that in the proposed apparatus the possibility is provided for closing one of the channels for inlet of compressed air with a plug.

Closing one of the channels for inlet of compressed air from the side of one of the two end faces of the apparatus substantially expands its technological possibilities, since it makes it possible to use this apparatus both for driving pipes into earth during trenchless laying of underground communications and for repair of old pipelines, for example, sewerage. When pipes are being driven into earth the plug is set in the channel for supplying compressed air in the front part of the air distribution system, while the air duct is connected to the channel for supplying compressed air, which channel is made in the rear part of the air distribution system, wherein the front portion of the apparatus is mounted in a pipe.

During the repair of old pipelines the plug is set in the channel for supply of compressed air in the rear portion of the air distribution system, while the air duct is connected to the channel for supply of compressed air which is made in the front portion of the air distribution system. The air duct is positioned in the old pipe. When the apparatus moves along the old pipe it destroys the pipe and pieces of that pipe are driven by the apparatus into earth, wherein the apparatus pulls a new pipe which is periodically lengthened with additional sections. When there is an air duct behind the apparatus, serious difficulties arise in the lengthening of the pipes.

The principles of the invention will be further discussed with reference to the drawings wherein preferred embodiments are shown. The specifics illustrated in the drawings are intended to exemplify, rather than limit, aspects of the invention as defined in the claims.

DESCRIPTION OF PREFERRED EMBODIMENTS

Figure 1A:
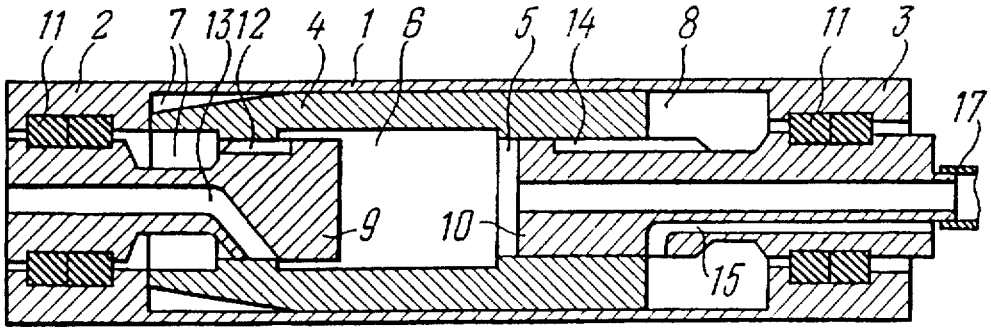
FIG. 1*a* is a longitudinal section view of an apparatus for impact action made in accordance with the present invention and in which the air duct is connected to one of the end faces of the body of the apparatus, at the moment of impact of the striker against the front portion of the body.

Consideration will now be given to a concrete embodiment of the apparatus for impact action, made in accordance with the present invention and shown in FIG. 1*a*. This apparatus for impact action comprises a body 1 with a front end face 2 and with a rear end face 3. A striker 4 having a central channel 5 and an inner cavity 6 is mounted capable of reciprocal movement in the body 1. Furthermore, the apparatus comprises a front working chamber 7 and a rear working chamber 8, an air distribution system consisting of a front sleeve 9 and a rear sleeve 10 which are cantilever supported respectively in the front end face 2 and the rear end face 3 of the body 1 by means of elastic elements 11. The front sleeve 9 of the air distribution system is made with a channel 12 for feeding compressed air from the inner cavity 6 of the striker 4 into the front working chamber 7 of the apparatus, and with a channel 13 for exhaust of spent air from the front working chamber 7 into the environment through the front end face 2 of the body 1. The rear sleeve 10 of the air distribution system is made with a channel 14 for feeding compressed air from the inner cavity 6 of the striker 4 into the rear working chamber 8 of the apparatus, with a channel 15 for exhaust of spent air from the rear working chamber 8 into the environment through the rear end face 3 of the body 1 of the apparatus, and with a channel 16 for supplying compressed air into the inner cavity 6 of the striker, communicating by means of an air duct 17 with a source of compressed air, i.e. with a compressor (not shown in the drawings).

The apparatus described above operates in the following manner. At the beginning of the working cycle the striker 4 occupies the position shown in FIG. 1*a*. Compressed air from a source of compressed air, i.e. compressor (now shown in the drawings), is fed through the air duct 17 and along the channel 16 into the cavity 6 of the striker 4. Then the compressed air is fed from the cavity 6 of the striker 4 through the channel 12 into the front working chamber 7. Since the rear working chamber 8 at this moment is communicating through channel 15 with the environment, then due to the pressure of compressed air in the front working chamber 7 the striker moves from the front end face 2 toward the rear side face 3 of the body 1. When the striker 4 moves it closes the channel 15, as a result of which exhaust of spent air from the rear working chamber 8 into the environment ceases. Wherewith the striker 4 closes the channel 12 which prevents the feeding of spent air from the compressor into the front working chamber 7. However, during that same displacement of the striker 4 it opens the channel 14, which results in feeding compressed air into the rear chamber 8 along that channel 14 from the compressor through the air duct 17, the channel 16 and inner cavity 6 of the striker. This results in the striker 4 stopping without impact against the rear end face 3 of the body 1 and then to the beginning of movement of the striker 4 from the rear end face 3 of the body 1 to its front end face 2. This position of the apparatus for impact action is shown in FIG. 1*b*. Simultaneously with this the striker 4 opens the channel 13, as a result of which exhaust of compressed air takes place along that channel 13 from the front working chamber 7 through the front end face 2 of the body 1 into the environment. This results in a rapid acceleration of movement of the striker 4 from the rear end face 3 of the body 1 to its front end face 2 and to a sharp impact of the striker 4 against the front end face 2 of the body 1. In other words the apparatus for impact action again occupies the position shown in FIG. 1*a*. Then the above-described cycle of operation of the apparatus for impact action is repeated a number of times.

In order to drive pipes into earth during trenchless laying of communications, the apparatus is connected at its front end face to the pipe being driven and loads it into earth by impacts transmitted by the apparatus for impact action via its body to the rear end face of the pipe.

Figure 1B:
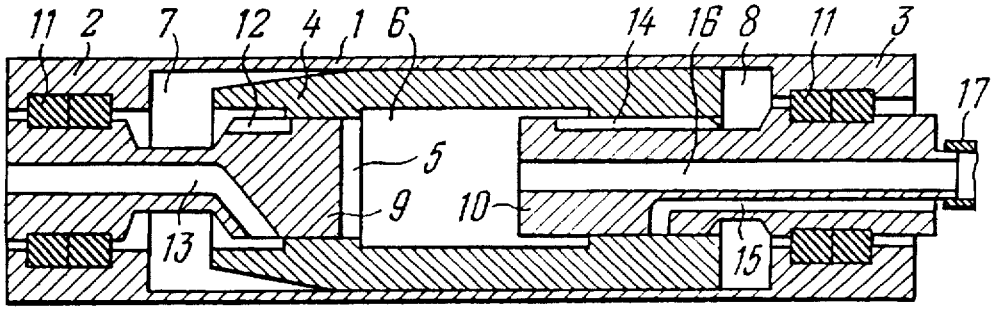
FIG. 1*b* is a longitudinal section view of the apparatus for impact action shown in FIG. 1*a* at the moment when the striker occupies a position maximum spaced from the front portion of the body.
Figure 2A:
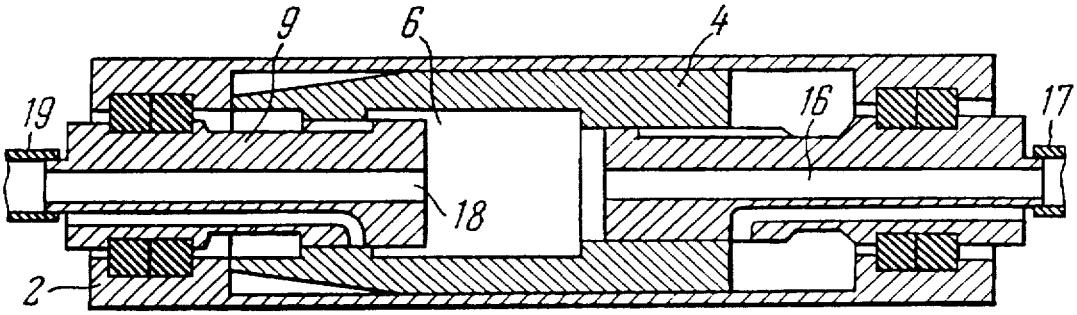
FIG. 2*a* is a longitudinal section view of an apparatus for impact action, which is a subsequent embodiment of the apparatus in accordance with the present invention in which the air duct is connected to the front and rear end faces of the body of the apparatus, at the moment of impact of the striker against the front portion of the body.
Figure 2B:
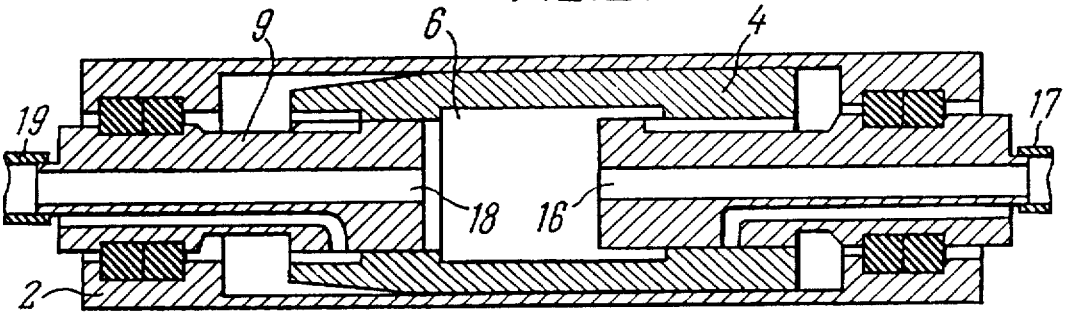
FIG. 2*b* is a longitudinal section view of the apparatus for impact action shown in FIG. 2*a* at the moment when the striker occupies a position maximum spaced from the front portion of the body.

Another embodiment of the present invention is possible in which the apparatus for impact action is made similar to the apparatus shown in FIG. 1*a* and FIG. 1*b* with the exception that an additional channel 18 is made in the front sleeve 9 of the air distribution system for the inlet of compressed air into the inner cavity 6 of the striker 4, while the apparatus itself is additionally provided with an air duct 19 communicating with the additional channel 18 from the side of the front end face 2 of the body 1 of the apparatus. This apparatus is shown in FIG. 2*a* and FIG. 2*b*. This apparatus for impact action operates in a manner similar to the operation of the apparatus shown in FIG. 1*a* and FIG. 1*b* with the exception that compressed air from the compressor is fed simultaneously along channel 16 and along channel 18. Due to this the power of the apparatus increases. It is advisable that such an apparatus be used when old pipelines are being replaced by new ones. In order to replace an old pipeline the air duct 19 is placed in that old pipeline and a first section of the new pipeline is connected to the rear end face 3 of the body 1 of the apparatus, and the apparatus is actuated. Moving under the effect of its own impacts along the old pipeline, the apparatus destroys the old pipeline with its front end face, pressing fragments of the old pipeline into earth, and pulling behind it a new section of the pipeline into the formed channel. As the apparatus moves the new pipeline is built up with new sections.

Figure 3A:
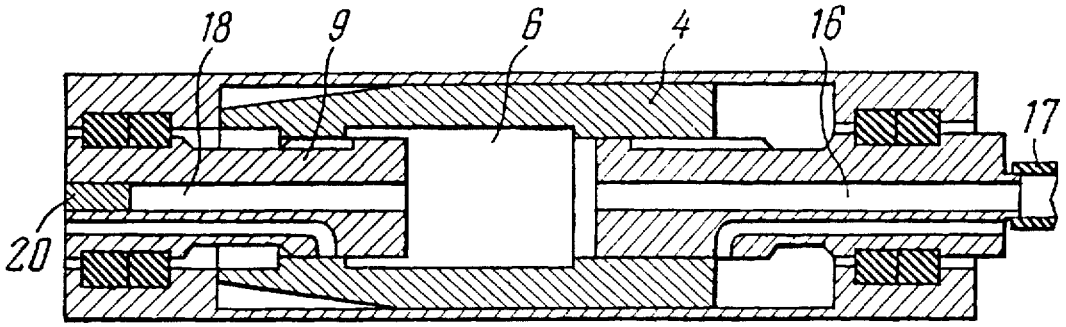
FIG. 3*a* is a longitudinal section view of an apparatus for impact action, which is one more embodiment of the apparatus made in accordance with the present invention and in which the air duct is connected to the rear end face of the body of the apparatus, and a plug is set in a channel for supplying compressed air into the inner cavity of the striker, which channel is made in the front portion of the air distribution system, at the moment of impact of the striker against the front portion of the body.
Figure 3B:
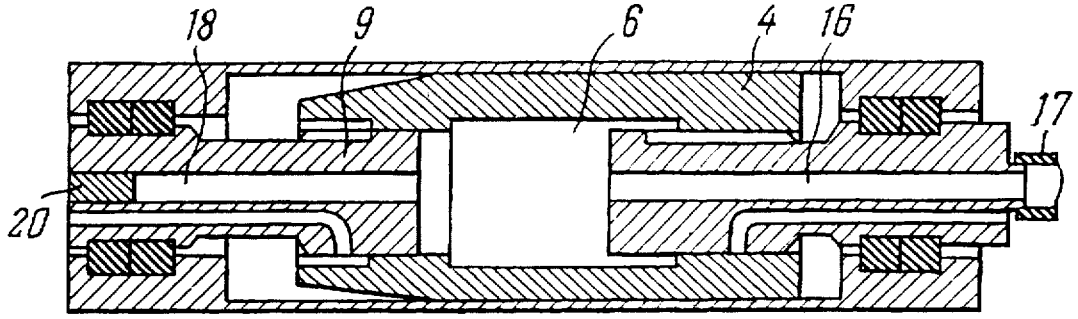
FIG. 3*b* is a longitudinal section view of the apparatus for impact action shown in FIG. 3*a* at the moment when the striker occupies a position maximum spaced from the front portion of the body.

Another embodiment of the present invention is possible wherein the apparatus for impact action is made similar to the apparatus for impact action shown in FIG. 2*a* and FIG. 2*b* with the exception that a plug 20 is secured in the channel 18 for supplying compressed air into the inner cavity 6 of the striker 4, while the air duct is connected only to the channel 16. Such an apparatus for impact action is shown in FIG. 3*a* and FIG. 3*b*.

Figure 4A:
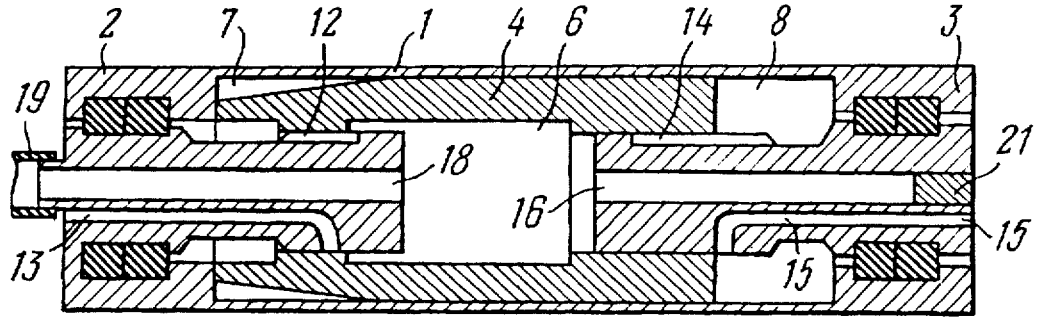
FIG. 4*a* is a longitudinal section view of an apparatus for impact action, which is the next embodiment of the apparatus in accordance with the present invention in which the air duct is connected to the front end face of the body of the apparatus and a plug is set in the channel for supplying compressed air into the inner cavity of the striker, which channel is made in the rear portion of the air distribution system, at the moment of impact of the striker against the front portion of the body.
Figure 4B:
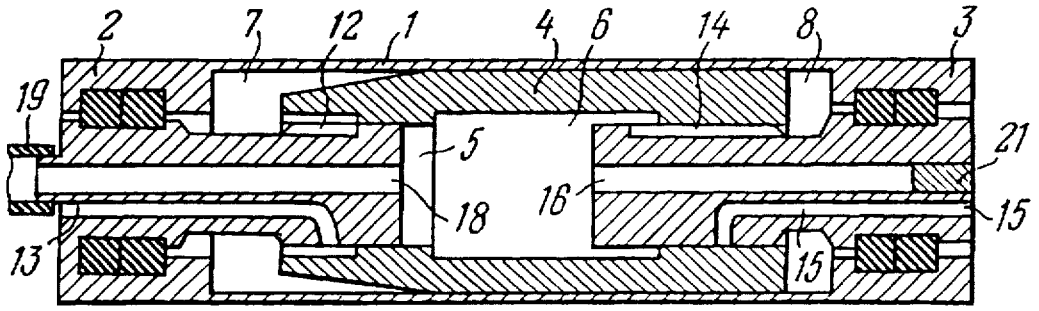
FIG. 4*b* is a longitudinal section view of the apparatus for impact action shown in FIG. 4*a* at the moment when the striker occupies a position maximum spaced from the front portion of the body.

It should be noted that as a rule work related to replacing old pipelines under urban conditions is carried out through already existing manholes of already existing urban communications. The practice of carrying out such work has shown that it is sensible to effect the connection of the compressor to one of the end faces of the apparatus for impact action, while building up the new pipeline should advisably be effected from the other end face of the pipeline. Such a technology of replacing old pipelines with new ones causes the apparatus for impact action shown in FIG. 4*a* and FIG. 4*b* to be used. Such an apparatus for impact action is made similar to the apparatus for impact action shown in FIG. 2*a* and FIG. 2*b* with the exception that a plug 21 is secured in the channel 16 for supplying compressed air into the inner cavity 6 of the striker 4, while the air duct 19 is only connected to the channel 18.

Such an apparatus for impact action operates in the following manner. Compressed air flows along the air duct 19 connected to the front end face 2 of the body 1 and then along the channel 12 into the inner cavity 6 of the striker 4, and from the cavity 6 along the channel 12 into the front working chamber 7. At that moment the rear working chamber 8 communicates through channel 15 with the environment, and therefore the striker 4 due to the pressure of the compressed air in the working chamber 7 moves from the front end face 2 toward the rear end face 3 of the body 1. When the striker 4 is moving it closes the channel 15 and the channel 12, opens the channel 13 and the channel 14. As a result compressed air is fed from the cavity 6 of the striker 4 through the channel 14 into the rear working chamber 8. Wherein the front chamber 7 through the channel 13 communicates with the environment. As a result of the action of the compressed air on the striker 4 from the side of the rear working chamber 8, the striker stops without impact against the rear end face 3 of the body 1. Wherewith the striker 2 occupies the position shown in FIG. 4*b*. Then an abrupt movement of the striker 4 begins from the rear end face 3 of the body 1 toward its front end face 2, which terminates with a sharp impact of the striker 4 against the front end face 2 of the body 1. As a result of this the striker 4 again occupies the position shown in FIG. 4*a*. Subsequently the cycle of operation of the apparatus for impact action is repeated a number of times.

It should now be apparent that the apparatus for impact action as described hereinabove possesses each of the attributes set forth in the specification under the heading "Summary of the Invention" hereinbefore. Because it can be modified to some extent without departing from the principles thereof as they have been outlined and explained in the specification, the present invention should be understood as encompassing all such modifications as are within the spirit and scope of the following claims.

What is claimed is:

1. An apparatus for impact action comprising:

a body;

a striker having a through central channel, the striker being positioned inside said body and capable of performing reciprocal movement therein;

a front chamber defined by said body and said striker;

a rear chamber defined by said body and said striker;

an air duct; and an air distribution system which is autonomous for each of said front chamber and said rear chamber, said air distribution system including first separate channel for the inlet of a fluid medium into said front chamber, second separate channel for the exhaust of the fluid medium from said front chamber, third separate channel for the inlet of the fluid medium into said rear chamber, and fourth separate channel for the exhaust of the fluid medium from said rear chamber, whereby separate autonomous control of each of said front chamber and said rear chamber is achieved.

2. An apparatus for impact action as in claim 1 wherein:

said air distribution system includes a sleeve with channels, the sleeve having at least two sleeve parts, the body having two end faces, and at least one sleeve part is cantilever supported at each end face.

3. An apparatus for impact action as in claim 2 wherein:

said air duct is connected to one of the end faces of said body.

4. An apparatus for impact action as in claim 2 wherein:

said air duct is connected to both end faces of said body.

5. An apparatus for impact action as in claim 2 wherein:

said parts of said sleeve are secured to the body by means of an elastic element.

* * * * *